US012599230B2

(12) United States Patent
Mao

(10) Patent No.: US 12,599,230 B2
(45) Date of Patent: Apr. 14, 2026

(54) STORAGE CABINET FOR DANCING MIRROR WITH ENLARGED DISPLAY SCREEN AND AUDIO

(71) Applicant: Zhongshan Bliss Medical Instrument Co., Ltd, Zhongshan (CN)

(72) Inventor: Gang Mao, Shenzhen (CN)

(73) Assignee: Zhongshan Bliss Medical Instrument Co., Ltd, Zhongshan (CN)

( * ) Notice: Subject to any disclaimer, the term of this patent is extended or adjusted under 35 U.S.C. 154(b) by 137 days.

(21) Appl. No.: 18/800,618

(22) Filed: Aug. 12, 2024

(65) Prior Publication Data

US 2025/0098854 A1 Mar. 27, 2025

(51) Int. Cl.
*A47B 81/06* (2006.01)
*A47B 67/00* (2006.01)

(52) U.S. Cl.
CPC ..... *A47B 81/06* (2013.01); *A47B 67/005* (2013.01)

(58) Field of Classification Search
CPC ..... A47B 81/06; A47B 67/005; A47B 81/00; A47B 67/02; A47B 2220/0091; A47B 51/00; A47B 46/00; A47F 7/02
See application file for complete search history.

(56) References Cited

U.S. PATENT DOCUMENTS 2,199,731 A * 5/1940 Pryne ..... A47B 67/02 D6/559
2006/0261714 A1* 11/2006 Hazzard ..... A47B 81/064 312/319.8
2008/0113820 A1* 5/2008 Tedsen ..... G07F 17/32 463/46
2008/0143222 A1* 6/2008 Greiner ..... A47B 49/004 312/227
2012/0068582 A1* 3/2012 Elderkin ..... E05B 47/004 312/227
2017/0181541 A1* 6/2017 Stanley, Jr. ..... H02J 7/0042
2021/0259413 A1* 8/2021 Lobello ..... A47B 81/064
2023/0255433 A1* 8/2023 Jun ..... H04W 4/80 15/319
2025/0244558 A1* 7/2025 Primm ..... A47G 1/24

FOREIGN PATENT DOCUMENTS

GB 2487748 A * 8/2012 ..... A47B 67/00

* cited by examiner

*Primary Examiner* — Hiwot E Tefera

(74) *Attorney, Agent, or Firm* — JEEN IP LAW, LLC

(57) ABSTRACT

A storage cabinet for dancing mirror with an enlarged display screen and an audio is provided, which includes a cabinet body and a cabinet door rotatably connected to the cabinet body. An outer surface of the cabinet door is embedded with a mirror, an interior of the cabinet door is fixed with a storage rack by a screw; a bottom of the cabinet body is fixed with an audio body; a display screen placement chamber with a top opening is provided between the storage rack and the cabinet door; a sliding groove is provided on an inner wall of the display screen placement chamber; the display screen placement chamber is provided with an enlarged display screen body connected to the audio body, and a sliding rail that matches the sliding groove is fixed on a side wall of the enlarged display screen body.

5 Claims, 2 Drawing Sheets

STORAGE CABINET FOR DANCING MIRROR WITH ENLARGED DISPLAY SCREEN AND AUDIO

CROSS-REFERENCE TO RELATED APPLICATIONS

This application claims priority to Chinese Patent Application No. 202322622000.2, filed on Sep. 26, 2023, which is hereby incorporated by reference in its entirety.

TECHNICAL FIELD

The present disclosure relates to the field of dancing mirror technologies, and in particular, to a storage cabinet for dancing mirror with an enlarged display screen and an audio.

BACKGROUND

The storage cabinet for dancing mirror is a storage structure with a mirror for a dancer to self-view on a surface, which generally consists of a cabinet body and a cabinet door. At the same time, a makeup mirror surface is embedded on an outer surface of the cabinet door. Although the existing storage cabinet for dancing mirror can meet the general needs of use, its functions are relatively limited, and it can only simply store some accessories and achieve the function of self-checking for the dancer by a mirror. It does not have a storage function for an audio, its applicability and practicality are limited.

SUMMARY

A purpose of the present disclosure is to provide a storage cabinet for dancing mirror with an enlarged display screen and an audio, which has a reasonable structural setting and is conducive to achieving audio performance.

The technical solution for achieving the purpose of the present disclosure is a storage cabinet for dancing mirror with an enlarged display screen and an audio, including a cabinet body and a cabinet door rotatably connected to the cabinet body; an outer surface of the cabinet door is embedded with a mirror, where an interior of the cabinet door is fixed with a storage rack by a screw;

- a bottom of the cabinet body is fixed with an audio body;
- a display screen placement chamber with a top opening is provided between the storage rack and the cabinet door;
- an inner wall of the display screen placement chamber is provided with a sliding groove;
- the display screen placement chamber is provided with an enlarged display screen body connected to the audio body, and a sliding rail that matches the sliding groove is fixed on a side wall of the enlarged display screen body;
- the enlarged display screen body is capable of being raised and lowered within the display screen placement chamber, and the sliding rail moves and is limited within the sliding groove.

In an embodiment of the present disclosure, a top of the enlarged display screen body is fixed with a support bracket;

the audio body is a Bluetooth audio.

In an embodiment of the present disclosure, the storage rack is provided with a U-shaped clamp slot.

In an embodiment of the present disclosure, both the cabinet body and the cabinet door are metal structures.

In an embodiment of the present disclosure, the storage rack is a plastic structure.

The present disclosure has positive effects: the structure of the present disclosure is reasonably arranged, and it is provided with a mirror surface, which can achieve self-viewing for a dancer. At the same time, it is further provided with the audio body and the enlarged display screen, which can also achieve the purpose of playing sound and enlarging the screen, which is conducive to achieving sound performance and improving its applicability, and has strong practicality.

BRIEF DESCRIPTION OF DRAWINGS

In order to facilitate a clear understanding of the content of the present disclosure, a further detailed explanation of the present disclosure will be provided based on specific embodiments and in combination with the accompanying drawings.

Numeral reference: 1—cabinet body, 2—cabinet door; 3—mirror, 4—storage rack, 5—U-shaped clamp slot, 6—audio body, 7—display screen placement chamber, 8—sliding groove, 9—enlarged display screen body, 10—support bracket.

DESCRIPTION OF EMBODIMENTS

The following will provide a clear and complete description of the technical solution in the embodiments of the present disclosure, based on the accompanying drawings. Obviously, the described embodiments are only a part of the embodiments of the present disclosure, not all of them. Based on the embodiments in the present disclosure, all other embodiments obtained by those skilled in the art without creative work are within the protection scope of the present disclosure.

EMBODIMENTS

Figure 1:
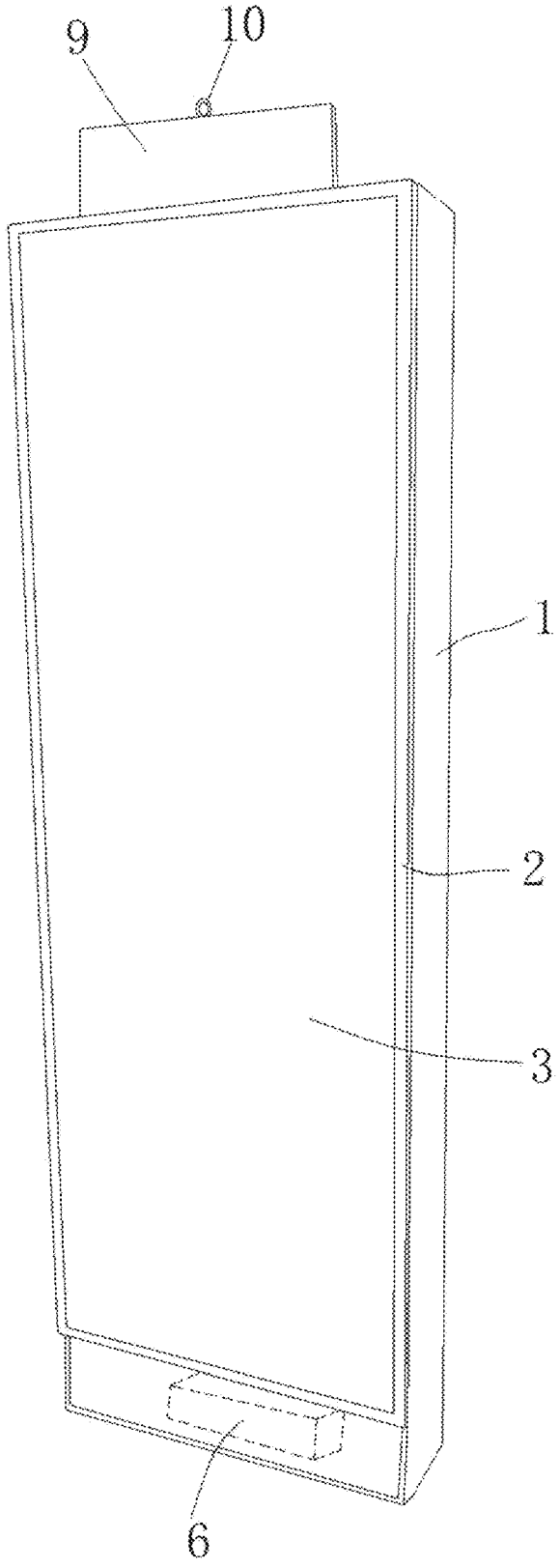
FIG. 1 is a schematic structural diagram of the present disclosure.
Figure 2:
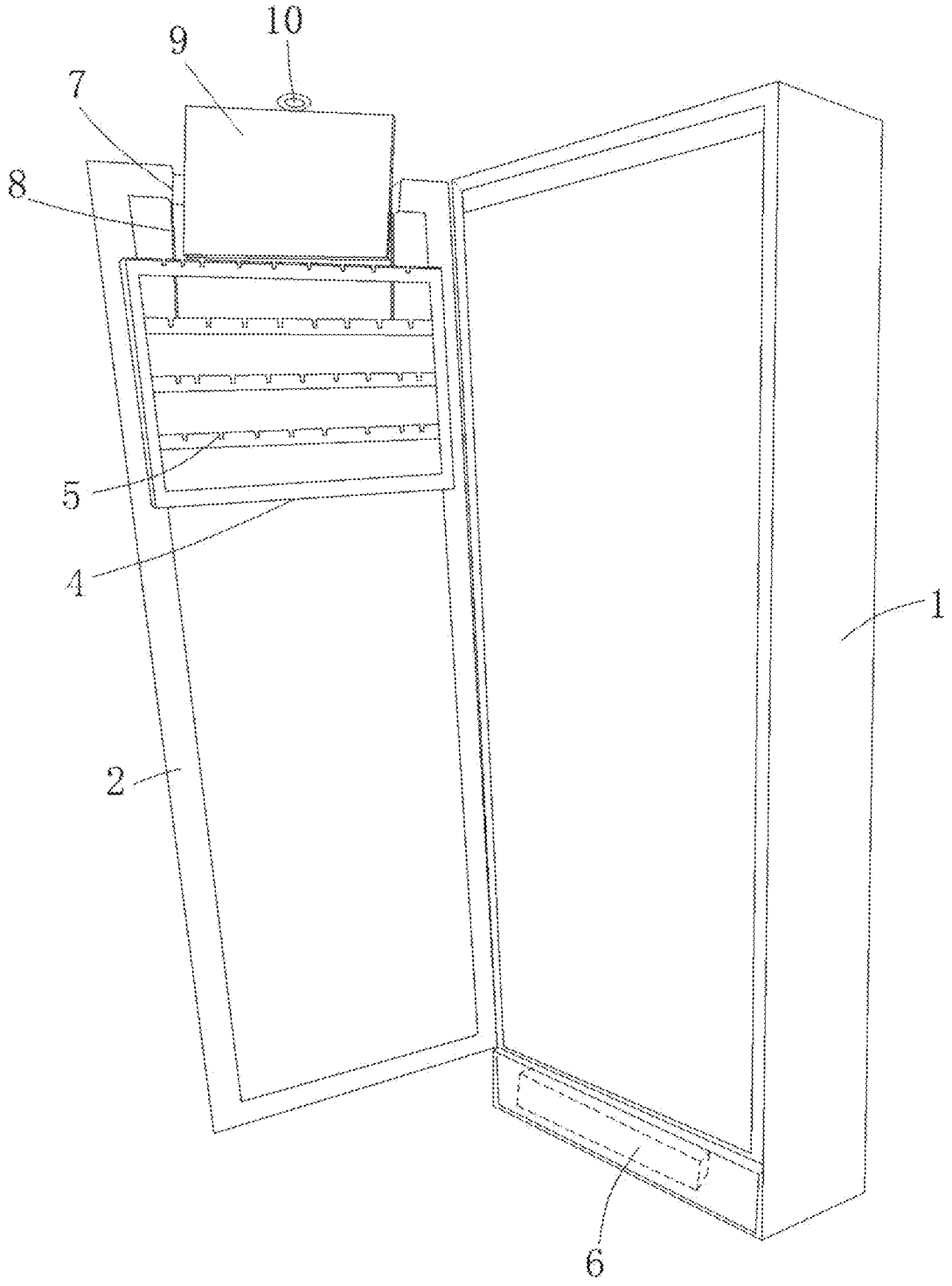
FIG. 2 is a schematic diagram of an internal structure of the present disclosure.

As shown in FIGS. 1 and 2, a storage cabinet for dancing mirror with an enlarged display screen and an audio includes a cabinet body 1 and a cabinet door 2 rotatably connected to the cabinet body 1. An outer surface of the cabinet door 2 is embedded with a mirror 3, an interior of the cabinet door 2 is fixed with a storage rack 4 by a screw; in this embodiment, the above structures are all conventional structures of the prior art, and are simply applied, so they are not described in detail. The cabinet body 1 and cabinet door 2 are both metal structures. The storage rack 4 is a plastic structure. The storage rack 4 is provided with a U-shaped clamp slot 5. In this embodiment, the U-shaped clamp slot 5 on the storage rack 4 is mainly used for locking and positioning various structures.

A bottom of the cabinet body 1 is fixed with an audio body 6; the audio body 6 is a Bluetooth audio.

A display screen placement chamber 7 with a top opening is provided between the storage rack 4 and the cabinet door 2; an inner wall of the display screen placement chamber 7 is provided with a sliding groove 8; the display screen placement chamber 7 is provided with an enlarged display screen body 9 connected to the audio body 6, and a sliding rail that matches the sliding groove 8 is fixed on a side wall of the enlarged display screen body 9; the enlarged display screen body 9 can be raised and lowered within the display screen placement chamber 7, and the sliding rail moves and is limited within the sliding groove 8. In an implementation, a top of the enlarged display screen body 9 is fixed with a support bracket 10; in this embodiment, the sliding groove 8 is matched with the sliding rail to achieve the lifting and lowering of the enlarged display screen body 9, so that the enlarged display screen body 9 can extend out of the cabinet body 1 or be stored inside the cabinet body 1, thereby improving the convenience of use.

The present disclosure has positive effects: the structure of the present disclosure is reasonably arranged, and it is provided with a mirror, which can achieve self-viewing for a dancer. At the same time, it is further provided with the audio body and the enlarged display screen, which can also achieve the purpose of playing sound and enlarging the screen, which is conducive to achieving sound performance and improving its applicability and has strong practicality.

The standard parts used in this embodiment can be directly purchased from the market, while the non-standard structural components recorded in the specification can also be processed without any doubt based on existing technical knowledge. At the same time, connection methods of each component adopt mature conventional means in the existing technology, and the machinery, parts, and equipment all adopt conventional models in the existing technology. Therefore, no specific description will be made here.

Obviously, the above embodiments of the present disclosure are only examples provided to clearly illustrate the present disclosure, and are not limitations on the embodiments of the present disclosure. For ordinary technical personnel in the relevant field, other forms of changes or modifications can be made based on the above explanation. It is not necessary and impossible to exhaustively list all embodiments here. And these obvious changes or variations deriving from the essential spirit of the present disclosure still fall within the protection scope of the present disclosure.

What is claimed is:

1. A storage cabinet for dancing mirror with an enlarged display screen and an audio, comprising a cabinet body and a cabinet door rotatably connected to the cabinet body; an outer surface of the cabinet door is embedded with a mirror, wherein an interior of the cabinet door is fixed with a storage rack by a screw;

a bottom of the cabinet body is fixed with an audio body;

a display screen placement chamber with a top opening is provided between the storage rack and the cabinet door;

an inner wall of the display screen placement chamber is provided with a sliding groove;

the display screen placement chamber is provided with an enlarged display screen body connected to the audio body, and a sliding rail that matches the sliding groove is fixed on a side wall of the enlarged display screen body;

the enlarged display screen body is capable of being raised and lowered within the display screen placement chamber, and the sliding rail moves and is limited within the sliding groove.

2. The storage cabinet for dancing mirror with an enlarged display screen and an audio according to claim 1, wherein a top of the enlarged display screen body is fixed with a support bracket;

the audio body is a Bluetooth audio.

3. The storage cabinet for dancing mirror with an enlarged display screen and an audio according to claim 2, wherein the storage rack is provided with a U-shaped clamp slot.

4. The storage cabinet for dancing mirror with an enlarged display screen and an audio according to claim 3, wherein both the cabinet body and the cabinet door are metal structures.

5. The storage cabinet for dancing mirror with an enlarged display screen and an audio according to claim 4, wherein the storage rack is a plastic structure.

* * * * *